US006153082A

United States Patent [19]

DeBord et al.

[11] Patent Number: 6,153,082

[45] Date of Patent: Nov. 28, 2000

[54] COPPER CATHODE STARTING SHEETS

[75] Inventors: Melvin G. DeBord; Harry E. Tallert, both of Amarillo; Michael D. Owsley, Canyon, all of Tex.

[73] Assignee: ASARCO Incorporated, New York, N.Y.

[21] Appl. No.: 09/332,333

[22] Filed: Jun. 14, 1999

Related U.S. Application Data

[62] Division of application No. 08/643,007, May 3, 1996, Pat. No. 5,961,797.

[51] Int. Cl.[7] ..... C25C 1/12

[52] U.S. Cl. ..... 205/575; 164/460; 164/476

[58] Field of Search ..... 205/575; 164/460, 164/476

[56] References Cited

U.S. PATENT DOCUMENTS

| | | | |
|---|---|---|---|
| 2,904,860 | 9/1959 | Hazelett | 22/57.4 |
| 3,036,348 | 5/1962 | Hazelett et al. | 22/57.4 |
| 3,199,977 | 8/1965 | Philips et al. | 75/76 |
| 3,474,516 | 10/1969 | Finley et al. | 29/423 |
| 3,504,429 | 4/1970 | Snelgrove | 29/527.6 |
| 3,764,308 | 10/1973 | Horn et al. | 75/211 |
| 3,865,744 | 2/1975 | Parker et al. | 252/188.3 R |
| 3,876,516 | 4/1975 | Pace et al. | 204/108 |
| 4,276,921 | 7/1981 | Lemmens et al. | 164/4 |
| 4,490,223 | 12/1984 | Baldwin | 204/106 |
| 4,733,717 | 3/1988 | Chia et al. | 164/476 |
| 4,936,127 | 6/1990 | Breitling | 72/42 |
| 4,946,575 | 8/1990 | Dompas | 204/288 |
| 5,103,892 | 4/1992 | Hugens, Jr. | 164/431 |
| 5,113,678 | 5/1992 | Mannaka et al. | 72/8 |
| 5,240,494 | 8/1993 | Williams et al. | 75/376 |
| 5,293,924 | 3/1994 | Hugens, Jr. et al. | 164/452 |
| 5,469,912 | 11/1995 | McAulliffe | 164/476 |
| 5,472,579 | 12/1995 | Mabuchi et al. | 204/145 R |
| 5,486,243 | 1/1996 | Hashiguchi et al. | 148/553 |

FOREIGN PATENT DOCUMENTS 1 294 694 11/1972 United Kingdom .

OTHER PUBLICATIONS

"Continuous Casting and Rolling of Copper Rod at the M.H. Olen Copper Refinery Uses No Wheel", *Wire Journal,* Sep. 1974, by John M.A. Dompas, Justin G. Smets and Jean R. Schoofs, pp. 118–132.

"Extractive Metallurgy of Copper", by A.K. Diswas and W.G. Davenport, Third Edtion Chapter 17, pp. 336–368.

*Primary Examiner*—Kathryn Gorgos
*Assistant Examiner*—Thomas H. Parsons
*Attorney, Agent, or Firm*—DeLio & Peterson; John J. Tomaszewski

[57] ABSTRACT

Wrought copper cathode starting sheets for use in the electrolytic production of copper made preferably by a continuous casting and rolling process are provided. Refined copper is melted in a shaft furnace and continuously cast preferably using a twin belt horizontal caster and straight line rolled to reduce the thickness of the casting by about 25% to 98% to produce a sheet having a thickness up to about 0.123 inch. The continuous sheet is cut after the rolling process from uncoiled sheet into discrete rectangular shapes suitable for use as a starting sheet, as a starting sheet blank or other metal sheet uses such as cladding and roofing.

12 Claims, 2 Drawing Sheets

COPPER CATHODE STARTING SHEETS

This is a divisional of application Ser. No. 08/643,007 filed on May 3, 1996, now U.S. Pat. No. 5,961,797.

BACKGROUND OF THE INVENTION

1. Field of the Invention

The present invention relates to the production of copper sheets and metal sheets and, in particular, to the use of wrought copper cathode starting sheets in the electrolytic production of copper in which the starting sheets are made by reducing cast copper to a wrought sheet form and preferably where a continuous casting process is used to make a continuous casting which is reduced in a rolling process to a starting sheet.

2. Description of the Related Art

Copper is produced by electrolytic processes such as electrorefining and electrowinning and, for convenience, the following description will be directed to electrorefining, although the products and processes of the invention are applicable to all electrolytic copper processes.

In one process, the electrorefining of copper comprises forming blister copper anodes by melting and casting individual anodes, followed by electrodepositing copper over a 1–2 week period onto pure copper starting sheets in electrolytic production cells from the impure anode. The pure copper cathode product is then melted and processed into the desired forms such as a wire bar, rod, billet, etc. It will be understood by those skilled in the art that the blister copper anodes contain about 98% copper and minor amounts of impurities, whereas pure (i.e. refined) copper electrodeposited either as a starting sheet or final product contains about 99.95% copper.

The copper cathode starting sheets are thin sheets of pure copper usually having a thickness of about 0.025 to 0.070 inch and have a width and length about that of a copper anode or cathode, i.e., 37 inch×40 inch. They are generally produced in special stripper cells by a 24-hour electrodeposition of copper onto a starter blank from an impure anode, usually called a stripper anode. The starter blank may be made of various metals, such as stainless steel and titanium, and the procedures of deposition are generally the same as in production cells to make pure copper cathode except for the daily withdrawal and stripping of the thin copper starting sheet deposit from the starter blank. The final preparation of the starting sheets may comprise stripping the copper from the blank, washing, straightening, stiffening and trimming to the desired size and attaching cut starter sheet loops for support in the production cell.

In another copper electrorefining process termed the ISA process, stainless steel sheets, like the starter blank used to make starting sheets, are used to plate copper thereon for typically seven days at which point the deposited copper is stripped and used to make copper products.

Unfortunately, however, the ISA process is expensive and the process requiring the preparation of starting sheets is inefficient and has been a continuing problem for the copper industry because the need for stainless steel sheets and the required high standards of quality for starting sheets result in high costs, both in labor and energy and time, and in a high scrap rate in the starter sheet process. For example, the starting sheet is generally of a fixed dimension limited by the size of the electrodeposition tank and it is industrially important that the stripper anode be of optimum size because of the high cost in energy and labor of making the anode and reprocessing of anode scrap remaining after electrodeposition. The anode however, must still provide substantially complete and even coverage over the starting blank and industry has had to correlate the anode size with the size of the starter blank and other process variables to minimize the cost of making starter sheets. U.S. Pat. No. 4,490,223, to Baldwin, provides a solution to the above problem by utilizing a specially designed footed stripper anode and this patent is hereby incorporated by reference. Starting sheets also because of their thinness and method of preparation (e.g., stripping of the sheet from the starter blanks) tend to warp or curl and not hang straight in the production cell causing contact with the anode and shorting and loss of electrical efficiency. In the ISA process, and in the copper starting sheet process, large inventories of stainless steel or other starter blank sheets must be used and inventoried which is expensive.

Bearing in mind the problems and deficiencies of the prior art, it is therefore an object of the present invention to provide copper cathode starting sheets which may be made efficiently and cost effectively.

A further object of the present invention is to provide wrought copper cathode starting sheets.

Another object of the present invention is to provide a method for the making of copper cathode starting sheets which have superior processing properties than electrodeposited starting sheets.

Other objects and advantages of the invention will in part be obvious and will in part be readily apparent from the specification.

SUMMARY OF THE INVENTION

The above and other objects and advantages, which will be apparent to those skilled in the art, are achieved in the present invention which is directed, in a first aspect, to copper cathode starting sheets which are characterized by being wrought.

The wrought starting sheets have a higher density than electrodeposited starting sheets and are more rigid, thus minimizing curling and shorting in the production cell and less physical damage to the sheet caused by handling and positioning of the starting sheet in the cell. The wrought copper cathode starting sheets may be made by a number of working processes. Working as used herein for making a wrought product is defined as any mechanical treatment of a metal product for the purpose of changing the dimensions or altering the physical or mechanical properties. Such treatments include hot working, cold working, rolling, forging, extruding, and drawing and combinations thereof.

The starting sheets are preferably made by a continuous process using molten refined copper which is continuously cast into a suitable cast shape for rolling in a rolling mill to a starting sheet form. The cast shape is preferably a sheet or strip about 0.2–1.5 inch thick, preferably 0.5–1 inch thick and about 30 inches to 50 inches wide. It is preferred that the casting be slightly wider than the width of the final starting sheet product to allow for trimming and other finishing operations. When rolled, the casting forms a finished sheet having the width and thickness useful as a starting sheet.

In another aspect of the invention, a method is provided for making a copper cathode starting sheet or other wrought copper product comprising the steps:

melting refined copper;

casting, preferably continuously, the molten copper into a cast form suitable for working into a sheet;

reducing by mechanically working the cast copper into a worked sheet having a thickness of about 25% to 98% of the casting thickness; and forming, e.g., cutting the worked sheet into discrete starting sheets or starting sheet blanks which blanks may be formed further to the desired starting sheet size by cutting, stamping, etc.

In a further aspect of the invention, it is preferred that the refined copper be melted in a shaft furnace to maintain the purity of the copper which melting process is well-known in the art. The molten copper is then continuously cast preferably in a Hazelett caster or other such horizontal belt continuous caster which will produce a cast form preferably a sheet or strip suitable for rolling into a starting sheet. It is a highly preferred feature of the invention that the casting be produced in a substantially horizontal plane, which casting is then fed in a substantially horizontal plane to a reducing device such as a rolling mill. The rolling mill typically comprises a number of rolling stands and in general it is preferred that the casting be in the form of a cast sheet or strip having a thickness of about 0.5–1 inch which casting will be rolled in a series of rolling stands to the desired thickness of about 0.025–0.070 inch. It is a further preferred aspect of the invention that the rolled sheet be cast and reduced in the same substantially horizontal plane and the rolled sheet either during rolling or after rolling not be coiled or otherwise deformed to minimize bending of the formed sheet and the creation of a bending memory moment being formed in the sheet. In another aspect of the invention, the sheet from the rolling mill is sheared or cut forming discrete rectangular shapes which are then cleaned and stacked or otherwise stored for use as starting sheets or as starting sheet blanks. It is preferred that a casting process generally termed a straight line casting process and straight line rolling process be employed as described hereinbelow.

In a further aspect of the invention, wrought copper cathode starting sheets preferably made by the above described continuous casting and rolling process are also provided.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
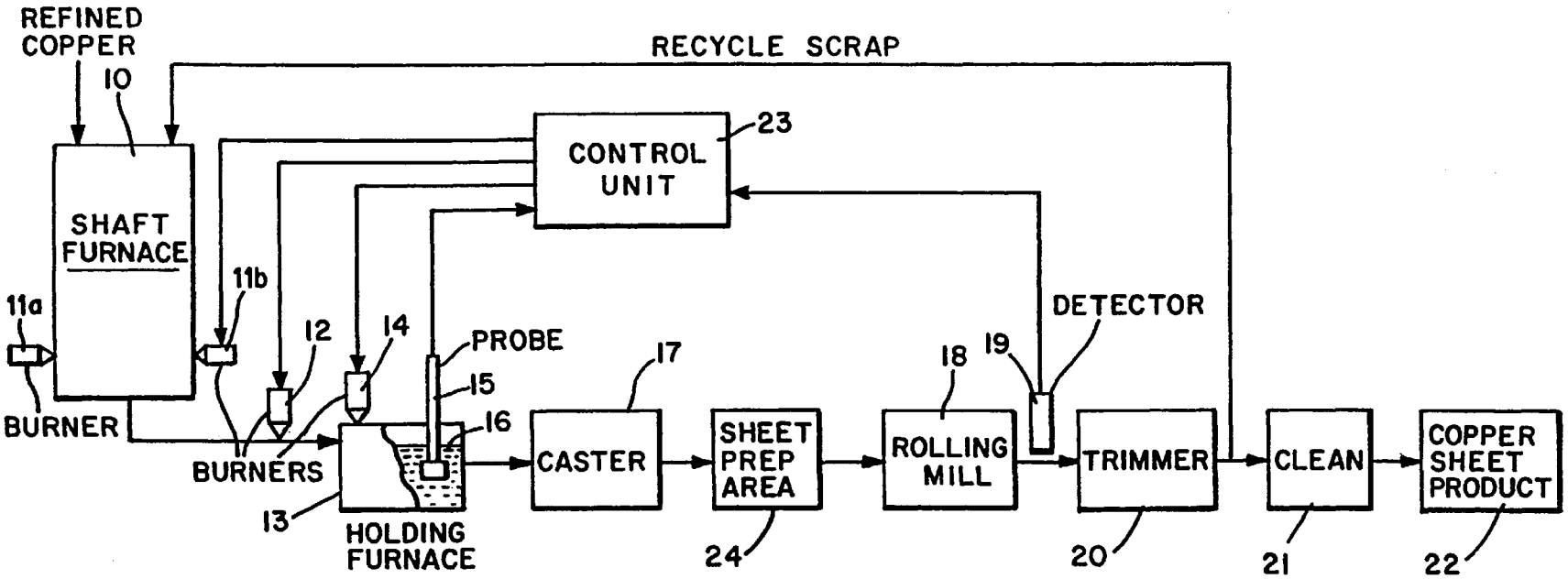
FIG. 1 is a schematic illustration of a process of the invention for making copper cathode starting sheets, starting with refined copper which is melted, continuously cast, rolled and trimmed to form the starting sheet product.

In describing the preferred embodiment of the present invention, reference will be made herein to FIGS. 1 and 2 of the drawing. Features of the invention are not necessarily shown to scale in the drawings.

The manufacture of copper products such as rod by continuous casting is well-known in the art. In "Extractive Metallurgy of Copper" by A. K. Diswas and W. G. Davenport, First edition, Chapter 17, pages 336–368, the manufacturing process is described in detail and this disclosure is hereby incorporated by reference.

In a preferred process of the invention refined copper such as cathode copper and copper meeting ASTM B-115 standard is melted, cast into a form suitable for working, e.g., continuously cast, reduced in thickness from about 25% to 98% of the original thickness preferably by hot rolling in a plurality of rolling stands and the rolled sheet cut to produce the copper cathode starting sheets. A minimum of sheet bending during the process such as coiling is desired to avoid curling of the starting sheet. Basically, as described in Phillips et al., U.S. Pat. No. 3,199,977, which patent is hereby incorporated by reference, cathodes or other forms of refined copper are melted in a furnace and the molten copper fed to a holding furnace for casting. The Asarco shaft furnace is predominately employed and the copper is placed in the furnace at the top and is heated and melted as it descends down the shaft. The heat is provided by impinging and ascending combustion gases produced in burners near the bottom of the furnace.

The furnace is primarily a melting unit and the burners and combustion gases are such that the copper is generally not oxidized during melting. This is achieved by using specially designed burners which insure that unconsumed oxygen in the burner does not enter the furnace shaft and by controlling the fuel/air ratio of the burners to provide a slightly reducing atmosphere in the furnace. In general, the fuel/air ratio is controlled to provide a reducing flame having a hydrogen content of the combusted fuel of up to about 3% by volume, usually 1%–3%.

There is generally no holding capacity in the furnace bottom and the molten copper flows immediately into a separate burner fired holding furnace. In many installations the launder connecting the shaft furnace and the holding furnace is also burner fired to likewise maintain the temperature of the copper and to minimize unwanted oxidation of the copper.

The molten copper from the holding furnace is then fed to a continuous caster such as a Properzi or Southwire wheel caster or preferably a Hazelett single or twin belt caster. The holding furnace has a metering device such as a stopper rod which controls the amount of molten copper flowing into the caster. A nozzle associated with the holding furnace distributes the molten copper to the caster and may be any configuration needed to form the casting, e.g., circular, square or rectangular in the form of a sheet.

In the Hazelett twin belt caster, molten copper is cast between two coincidentally moving steel belts and the casting, preferably a sheet or strip shape, is fed directly into a rolling mill or other reducing apparatus. Any shape casting can be worked to provide the finished starting sheet such as circular, square, etc. but a sheet shape is preferred. It is preferred that the caster be a so-called horizontal caster whereby the mill cavity between the belts is essentially horizontal so that the molten metal entering and the formed casting exiting the caster remains essentially horizontally. This minimizes any bending of the casting which may cause a bending memory effect in the final starting sheet product. U.S. Pat. No. 5,103,892 shows such a horizontal twin belt caster and this patent is hereby incorporated by reference. FIG. 2 shows a typical Hazelett twin belt caster and is described further hereinbelow. Typically the casting region is inclined at an angle of about 5° to 10° which is considered herein to be substantially horizontal.

U.S. Pat. No. 4,290,823 granted to J. Dompas, shows the basic continuous casting process for manufacturing copper and this patent is hereby incorporated by reference. An article entitled "Continuous Casting and Rolling of Copper Rod at the M. H. Olen Copper Refinery Uses No Wheel", by J. M. A. Dompas Jr., G. Smets and J. R. Schoofs (Wire Journal, September 1974, pages 118–132) also shows a typical rod making process. Regardless of the particular processes and controls used to melt, cast and mechanically work the copper into a sheet form, the main concern is to provide a copper cathode starting sheet having the quality of the refined copper from which it is made and of the final copper electrorefined product.

Any cast shape such as billets, cake, etc. may be worked into wrought starting sheets using the working processes described hereinbelow. Continuous casting is highly preferred herein and is employed, in a variety of forms, in the nonferrous and ferrous metals industry and elsewhere, to decrease production cost and increase product quality. Two basic systems known as the static and moving mold methods are used in continuous casting of discrete shapes such as billets or continuous shapes such as bar and sheet and both methods may be employed herein to produce a cast shape suitable for rolling into sheet. For example, a billet or cake may be formed and these shapes mechanically worked to form a sheet suitable for use as a copper cathode starting sheet. For hot rolling the casting would have to be heated. It is preferred that a continuous casting such as a strip or sheet be formed however, and the sheet fed hot from the caster into the mechanical working device such as reducing rolls.

In the static mold casting machines the walls of the mold are stationary, while the cast products move against and solidify within them. Moving mold casting machines employ a belt, or belts, chain, drum, wheel, or other surface which moves at approximately the same speed as the solidifying metal.

The continuous casting of metal in moving mold casting machines having at least one movable belt and a corresponding fixed or movable surface which together form a mold of two opposed surfaces in which the cast material solidifies is described in detail in the following U.S. Pat. Nos. which are incorporated herein by reference: 2,631,343; 2,904,860; 3,036,348; 3,123,873; 3,123,874; 3,167,830; 3,533,463; 3,864,973; 3,878,883; 3,921,697; 3,937,274; 3,949,805; 3,955,615; 4,002,197 and 4,854,371.

For a twin belt caster where two movable belts form the mold, in operation, a continuous stream of molten metal is supplied at the inlet of the machine to a cavity formed by a pair of movable flexible casting belts, positioned generally above the other, and side dam blocks, and emerges at the other end of the cavity (outlet of the machine) as a solidified metal having the dimensions and shape of the mold. The casting, preferably in a strip or sheet form, is subsequently fed to other apparatus such as a rolling mill for mechanical working, which changes its cross sectional dimensions. For example, twin belt casters of the type described are used to convert molten copper to a sheet shape up to about 1 inch thick which is then continuously fed to a rolling mill having a series of rolling stages for converting the thick cast sheet to thin sheet useful for a starting sheet. It is preferred that the twin belt caster be positioned essentially horizontally.

Another continuous casting moving mold method employs a casting wheel having a peripheral groove therearound. A portion of the peripheral groove is closed by an endless belt to form a mold into which molten metal is poured to be solidified into cast metal and discharged therefrom. Such designs may be seen in U.S. Pat. Nos. 3,279,000 and 3,469,620 which patents are hereby incorporated by reference. This continuous casting device is not as preferred as a horizontal belt caster because wide sheets cannot be easily cast and a memory moment may be formed in the casting.

Continuous casting using a static mold may be found in U.S. Pat. Nos. 2,938,251; 2,946,100; 3,066,364; 3,089,209; 3,098,269; and 3,115,686 which patents are hereby incorporated by reference. Basically, molten metal is continuously fed into the mold, freezes and the frozen product continuously removed from the mold. Generally, the mold is in a vertical position with the molten metal poured into the top of the mold and, as with the wheel caster, this type caster is not preferred because of the memory moment effect.

The casting then preferably travels through a sheet preparation area where any burrs or fins are removed and the casting is usually cooled by a water spray.

The production of copper rod by rolling is described in U.S. Pat. No. 4,936,127 to Breitling and discloses in general a side rolling mill operation. The disclosure of this patent is incorporated herein by reference.

In general, a rolling mill comprising a number of roll stands is used to reduce the strip, sheet or other casting form to the desired thickness preferably by passing it through successive rolls in the same direction wherein each roll in succession further reduces the thickness of the casting. For example, a number of roll stands may be used to reduce a cast sheet from about 0.5 inch to 1 inch thick in increments to about 0.15 to 0.123 inch, preferably 0.025 to 0.070 inch. Thickness of the casting may be greater or smaller and is reduced to provide any desired finished product range with it being preferred that the casting be reduced from about 25% to 98%, preferably 50%–95%, of its cast thickness. For a casting 0.5 inch to 1 inch, a preferred reduction range is above about 75%, e.g., 90%–98%. It is preferred to use a plurality of roll stands and each stand may reduce the stock being rolled by about 25%–40%. Lower or higher stand reductions may be employed. For example, a first stand reduction may be as high as 90%. In general, it is preferred that the maximum reduction be performed in the first rolling stand and a typical rolling schedule for 5 stands is 35–38% in the first stand, 33% in the second stand, 28% in the third stand, and 25% in each of stands 4 and 5. Other rolling schedules can suitably be employed.

Each separate roll stand is generally a complete assembly that slides into position on a guideway at a right angle to the rod rolling direction. A water-soluble oil-water lubricant mixture is delivered to each roll stand to act as a lubricant between casting and rods and floods the rolls and the copper rod to protect the rods, and to keep air from oxidizing the copper surface. The water-soluble oil is generally at an elevated temperature in order not to over cool the casting and thus produce too hard a sheet. The copper is at a temperature usually about 1600 to 1780° F. as it exits the caster. A rolling mill and its roll stands are well-known in the art and, in general, any type rolling mill may be used. Typically, the casting enters the rolling mill at about 1500–1650° F. These temperatures may vary widely as will be appreciated by those skilled in the art.

Upon leaving the rolling mill the sheet is flooded with a water spray or other suitable material to further cool and/or treat the sheet and is trimmed into discrete shapes either the size of the starting sheet or larger as a starting sheet blank which can be cut later to the desired size. Preferably, the rolled sheet is slightly wider than the width desired and the sheet as it travels from the rollers is trimmed at its sides and cut at intervals to provide the desired sheet length. The trimmed sheets are then cleaned to produce a starting sheet having the desired properties for use as a starting sheet. Cleaning with a $H_2SO_4$ and peroxide solution by transporting the trimmed sheets on a conveyor belt through the solution at 140 to 165° F. for 1 to 2 minutes may suitably be employed.

The wrought copper cathode starting sheet product may be characterized as having a thickness up to 0.123 inch, preferably 0.025 to 0.070 inch, a density greater than the density of electrolytically produced starting sheets, typically about twice the density and lie in a substantially single plane when hung vertically. There is substantially no curling or warping of the wrought sheet as contrasted to electrolytically produce starting sheets.

Referring now to FIG. 1, a copper continuous casting process for use in the method of the invention is shown. Copper cathodes or other refined copper forms including recycle scrap are added to the shaft furnace 10 and melted using burners 11*a* and 11*b*. Molten copper flows from the furnace into holding furnace 13. The molten copper may be heated during transfer from the shaft furnace 10 to holding furnace 13 by burner 12 and in the holding furnace by burner 14. Probe 15 is inserted into the molten copper 16 or its holding furnace 13 and may be used to monitor the quality of the copper or other process variables and output from the probe is relayed to control unit 23. The control unit 23 is shown receiving a number of inputs and is generally a computer device for controlling process variables such as caster speed, rolling mill reductions, and burners 11, 12 and 14. The molten copper 16 is fed into caster 17 and the casting passed through sheet preparation area 24 and fed into rolling mill 18 to produce copper sheets. Trimmer 20 is employed to trim the edges and/or shear or cut the continuous copper sheet into discrete sheets preferably the length of the starting sheet. A surface quality detector or other control device (such as a thickness gauge) 19 is used to measure the sheet with the output being relayed to control unit 23. The trimmed sheets are cleaned in unit 21 by passing the sheets through a cleaning solution such as $H_2SO_4/H_2O_2$ solution. In a preferred embodiment, any scrap from the process is recycled to be melted in shaft furnace 10. The rolling process shown may be defined as a straight line rolling process since no coiling or other such deformation of the rolled product is performed.

Figure 2:
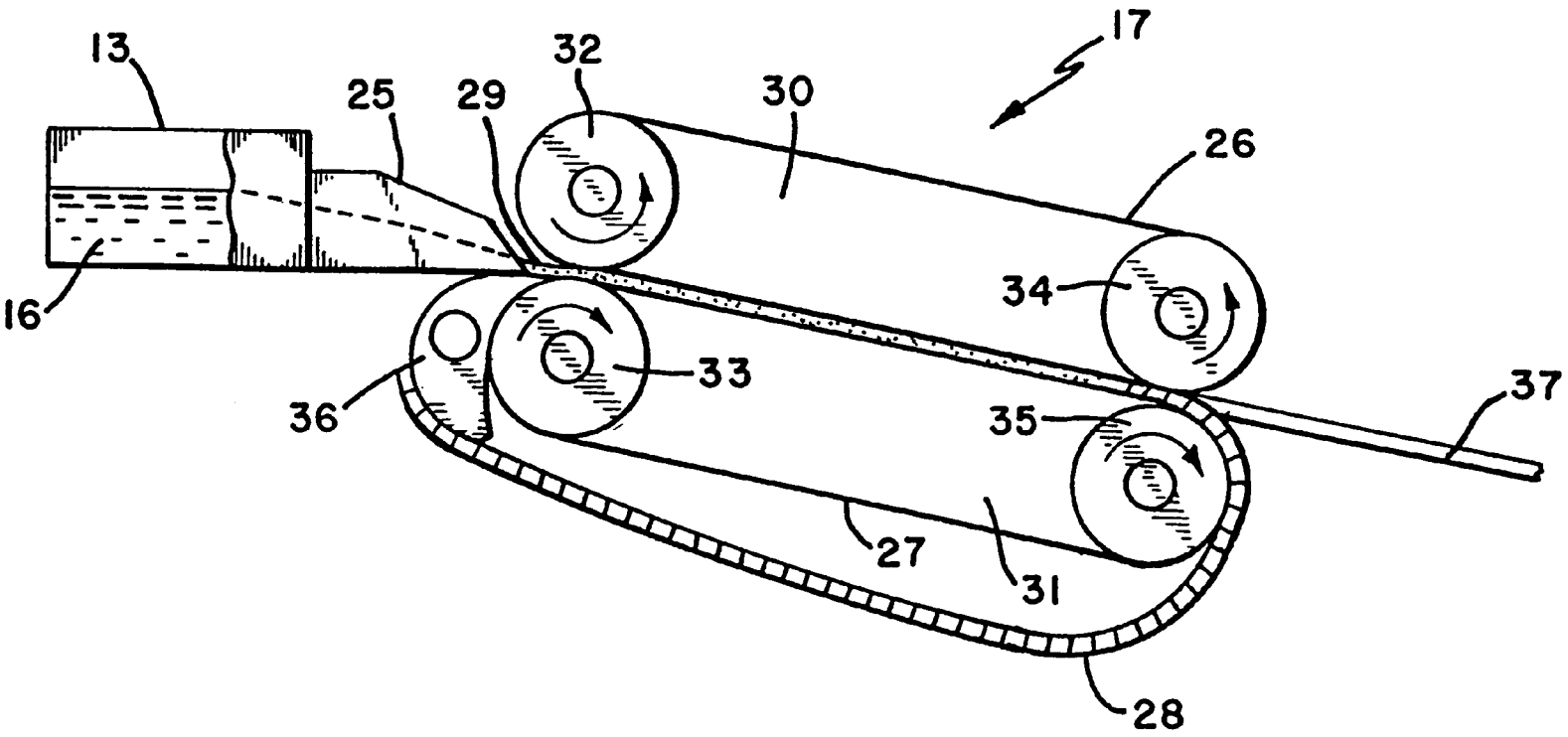
FIG. 2 is a schematic illustration of a twin-belt casting machine showing the continuous casting of a copper sheet.

A typical twin belt caster is shown in FIG. 2 being fed molten copper 16 from holding furnace 13. A tundish 25 supplies the molten copper to the input region of the caster 17 formed between spaced parallel surfaces of upper and lower endless flexible casting belts 26 and 27 respectively. The cavity formed between the belts 26 and 27 and dam blocks 28 (shown partially around lower carriages 31) may be defined as the casting region 29 wherein the molten metal is cast into a desired shape and solidified. The casting belts are preferably fabricated from steel, or other alloys, which provide toughness and resistance to abrasion and physical damage as well as resistance to the temperature shocks and heat differential stresses undergone during casting.

The casting belts 26 and 27 are supported on and driven by an upper and lower carriage generally indicated at 30 and 31, respectively. Both carriages are mounted on a machine frame (not shown). Each carriage includes two main rolls which support, drive and steer the casting belts. These rolls include upper and lower input rolls, 32 and 33 and upper and lower output rolls 34 and 35 respectively.

A flexible, endless side metal retaining dam 28 is disposed on each side of the casting belts to define the side edges of the casting region for confining the molten metal. The side dams 28 are guided at the input end of the casting apparatus 17 by crescent shaped members 36 which are mounted on the lower carriage 31.

During the casting operation, the two casting belts 26 and 27 are driven at about the same linear speed by a driving mechanism and the upper and lower carriages are preferably downwardly inclined in the downstream direction, so that the casting region 29 between the casting belts is inclined. This downward inclination facilitates flow of molten metal into the casting region. The casting 37 is shown exiting the caster.

The method of the invention may also be used to make copper or other metal sheet useful for roofing, cladding, etc.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for making copper cathode starting sheets for use in the electrorefining of copper by the electrodeposition of copper onto the starting sheet, the method comprising the steps of:

melting refined copper;

continuously casting the molten copper into a cast form for working into a sheet;

reducing the thickness of the continuous casting from about 25% to 98% by mechanically working the cast copper into a wrought sheet;

trimming the continuous wrought sheet into discrete rectangular sheets suitable for use as a starting sheet or as a starting sheet blank for the electrolytic deposition of copper thereon; and forming support means on the sheet for hanging the sheet vertically in an electrorefining cell.

2. The method of claim 1 wherein a horizontal belt caster is used to continuously cast the molten copper.

3. The method of claim 2 wherein a rolling mill is used to reduce the casting.

4. The method of claim 1 wherein a shaft furnace is used to melt the refined copper.

5. The method of claim 1 wherein the thickness of the wrought sheet is about 0.015 to 0.123 inch.

6. The method of claim 5 wherein the thickness of the wrought sheet is about 0.025 to 0.070 inch.

7. The method of claim 1 wherein the casting is formed into a wrought sheet by hot rolling.

8. The method of claim 7 wherein the rolling is performed using a straight line rolling mill.

9. In a method for a production of copper by electrorefining wherein copper is electrodeposited onto copper cathode starting sheets in electrolytic production cells from an impure copper anode, the improvement comprising using as the copper cathode starting sheet a wrought copper cathode starting sheet produced by melting refined copper; continuously casting the molten copper into a cast form for working into a sheet; reducing the thickness of the continuous casting from about 25% to 98% by mechanically working the cast copper into a wrought sheet; trimming the continuous wrought sheet into discrete rectangular sheets suitable for use as a starting sheet or as a starting sheet blank for the electrolytic deposition of copper thereof; and forming support means on the sheet for having the sheet vertically on an electrorefining cell; and having a thickness of about 0.015 to 0.123 inch.

10. The method of claim 9 wherein the thickness of the wrought sheet is about 0.025 to 0.70 inch.

11. The method of claim 9 wherein the copper cathode starting sheet is made by hot rolling.

12. The method of claim 9 wherein the copper cathode starting sheet is made by straight line hot rolling.

* * * * *

UNITED STATES PATENT AND TRADEMARK OFFICE

CERTIFICATE OF CORRECTION

PATENT NO. : 6,153,082
DATED : November 28, 2000
INVENTOR(S) : DeBord et al.

It is certified that error appears in the above-identified patent and that said Letters Patent is hereby corrected as shown below:

Specification,
Column 6,
Line 29, delete "0.15" and substitute therefor -- .015 --.

Claims,
Column 9, claim 9,
Line 3, delete "having" and substitute therefor -- hanging --.

Signed and Sealed this

Second Day of October, 2001

*Attest:*

Nicholas P. Godici

NICHOLAS P. GODICI
*Acting Director of the United States Patent and Trademark Office*

*Attesting Officer*